US006900736B2

(12) United States Patent
Crumb

(10) Patent No.: US 6,900,736 B2
(45) Date of Patent: May 31, 2005

(54) PULSE POSITION MODULATED DUAL TRANSCEIVER REMOTE CONTROL

(75) Inventor: Alan C. Crumb, Madison, NY (US)

(73) Assignee: Allied Innovations, LLC, Las Vegas, NV (US)

( * ) Notice: Subject to any disclaimer, the term of this patent is extended or adjusted under 35 U.S.C. 154(b) by 373 days.

(21) Appl. No.: 09/732,978

(22) Filed: Dec. 7, 2000

(65) Prior Publication Data

US 2002/0070875 A1 Jun. 13, 2002

(51) Int. Cl.[7] ..... G08C 19/00
(52) U.S. Cl. ..... 340/825.69; 4/492; 340/825.72
(58) Field of Search ..... 340/825.19; 4/172, 4/492, 496

(56) References Cited

U.S. PATENT DOCUMENTS 4,404,697 A * 9/1983 Hatcher ..... 4/492
5,559,720 A * 9/1996 Tompkins et al. ..... 364/505
5,651,500 A * 7/1997 Patterson et al. ..... 239/69
6,219,380 B1 * 4/2001 Wang et al. ..... 375/239
6,407,779 B1 * 6/2002 Herz ..... 348/734

* cited by examiner

*Primary Examiner*—Michael Horabik
*Assistant Examiner*—Matsuichiro Shimizu
(74) *Attorney, Agent, or Firm*—Christie, Parker & Hale, LLP

(57) ABSTRACT

A pulse position modulated radio remote control system using distributed solid state data processing that includes a remote-control unit and a master-control unit, each unit having an associated transceiver so that information in the form of radio signals can be exchanged bidirectionally between the two units. The master-control unit controls operating functions of a pool or spa on command from the remote-control unit. The master-control unit also monitors operating conditions of the pool or spa and sends information about those conditions of the pool or spa and sends information about those conditions to the remote-control unit on command from the remote-control unit. A display on the remote-control unit allows a user to determine the status of various operating parameters of the pool or spa, such as water temperature. The remote-control unit also has a keypad that allows the user to input signals to be sent to the master-control unit.

15 Claims, 7 Drawing Sheets

PULSE POSITION MODULATED DUAL TRANSCEIVER REMOTE CONTROL

BACKGROUND OF THE INVENTION

1. Field of the Invention

The present invention pertains to the field of remote-control devices, and more particularly to hand-held radio remote control units for pools and spas.

2. Background

A spa generally includes the following components: (1) a time clock; (2) a circulation pump; (3) a heater; (4) a thermostat; (5) a high- temperature limit device for safety; (6) an air blower or bubbler; (7) a light; and (8) an additional pump for jets used for hydro-massage. Spa owners typically do not keep their spas heated twenty-four hours per day, choosing instead to heat the spa only for use so as to minimize energy costs. Hence, the heater is equipped with an on/off switch and an accompanying thermostat. The time clock serves to operate the circulation pump for a few hours each day to keep the spa clean.

A conventional method by which an owner can prepare the spa for use requires the steps of going to the equipment area and throwing a toggle switch to the "on" position to bypass the timeclock, which turns on the pump. The owner must then switch the heater to the "on" position and adjust the thermostat to the desired temperature. There follows a waiting period for an unspecified amount of time for the spa to reach the desired temperature. If the water is unheated at the start of the process and the ambient temperature is low, the time required to heat the water can be quite long.

Periodically, the owner must either go to the heater to determine whether the heater is still on, i.e., that the water in the spa is not yet heated to the thermost at setting, or go to a fixed thermometer to check the temperature. To avoid having to go outside to the spa and the heater, the owner typically installs a hard-wired digital thermometer and thermostat control in a display box that is mounted to a wall inside the home. Such an instrument, however, is immobile, so that it cannot be carried around to check the temperature or give the status of any of the spa components. This type of unit is also relatively expensive. The owner would generally not have the option of installing several such devices throughout the home for more convenient monitoring. Additionally, such units are difficult to secure to prevent access by children. Moreover, a hard-wired device mandates that a conduit be run underground from an interior wall of the home to the outdoor spa. If added after the home is constructed, this may involve trenching and cutting through concrete walls of the home, requiring extensive and costly materials and labor in addition to inspections for compliance with building codes.

For the foregoing reasons it would be desirable for spa owners to use a remote-control unit to turn the spa on or off and to receive information on water temperature and working status of spa components. However, conventional remote-control devices for pools or spas do not monitor operating status. Thus, there is a need for a relatively inexpensive, hand-held device that enables a user to communicate bidirectionally with the spa from anywhere in the home so as to both control necessary operating functions and obtain status information regarding operating parameters.

SUMMARY OF THE INVENTION

The present invention is a unique and major advancement in the field of wireless remote control units for pools and spas. It utilizes Pulse Position Modulation ("PPM") and distributed solid state data processing to permit the half duplex, simultaneous transmission of multiple sensing and control signals on a single frequency. This permits bi-directional transmission of multiple control signals and data through a single transceiver at each site. By using PPM the allowable regulatory power levels are 17 dB higher, permitting a longer range and a reduction in interference susceptibility. PPM and distributed data processing permit using identical multiple data groups to assure accurate data transmission through the most severe interference. The data processing system includes address switches, in both the hand held remote unit and the master control unit, that prevent the system from responding to signals that do not have the proper address code. This permits the use of multiple systems in close proximity without interfering with each other. The system is therefore more reliable and lower in cost than existing devices.

The present invention is therefore directed to a relatively inexpensive, hand-held device that enables a user to communicate bidirectionally with the spa from anywhere in or near the home so as to both control necessary operating functions and obtain status information regarding operating parameters. To this end a PPM radio remote control has a remote-control unit and a master-control unit; and each unit has an associated transceiver. Preferably, the remote-control unit and the master-control unit can exchange information with each other bidirectionally via the transceivers. Advantageously, the remote-control unit includes a display from which a user can obtain status information received from the master-control unit on the working components of a pool or spa. Most desirably, the remote-control unit has a keypad with which the user can input control information for the master-control unit.

Accordingly, it is an object of the present invention to provide a remote-control device that can be used to turn spa equipment on or off reliably from a distance as well as to determine the water temperature in the spa. These and other objects, features, aspects, and advantages of the present invention will become better understood with reference to the following description and accompanying drawings.

BRIEF DESCRIPTION OF THE DRAWINGS

FIG. 2B is a schematic circuit diagram of decoder, address-switch, and display circuitry in a remote-control unit in the system of FIG. 1.

DETAILED DESCRIPTION OF THE PREFERRED EMBODIMENT

Figure 1:
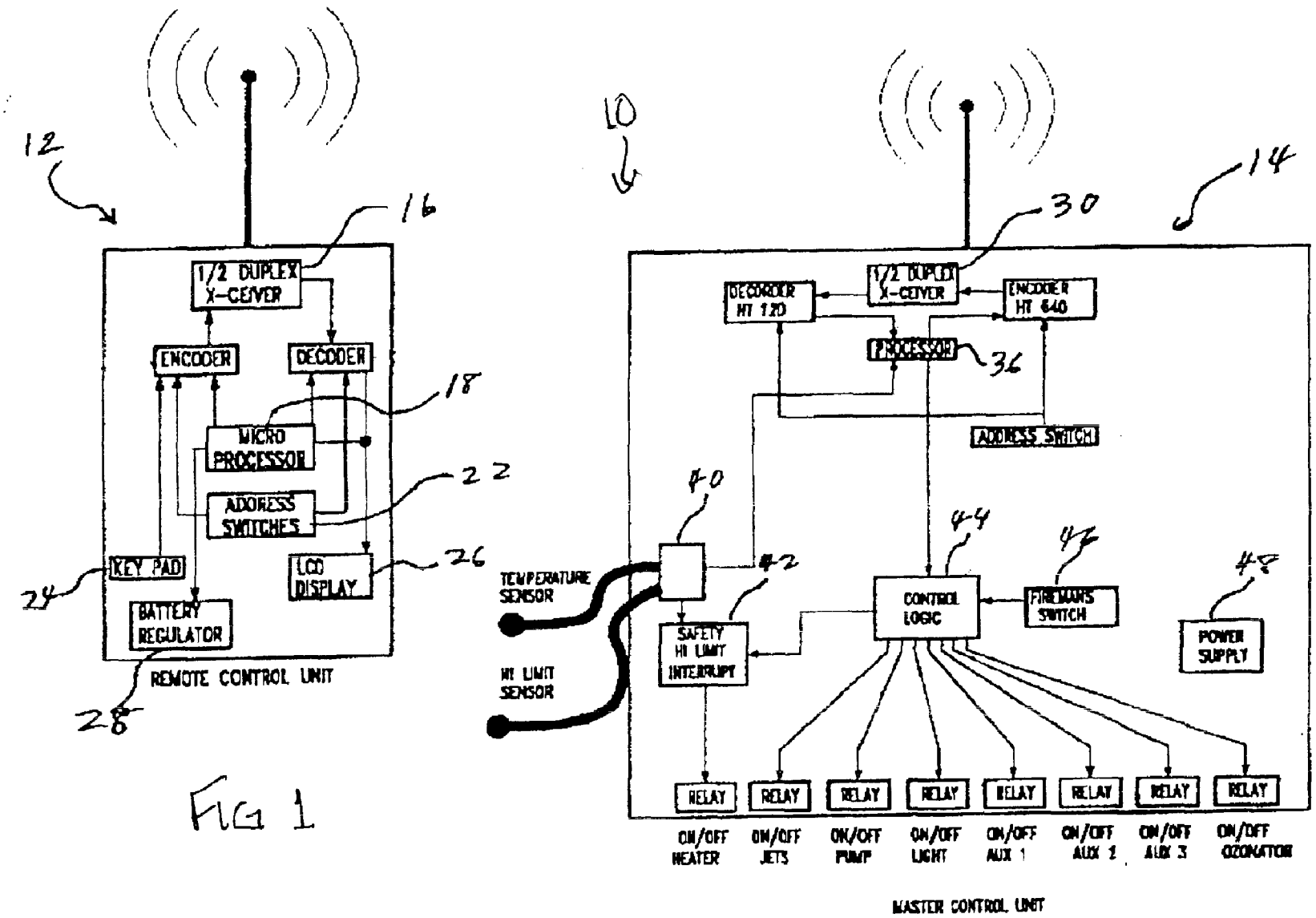
FIG. 1 is a block diagram of a remote-operated control system for a pool or spa.

Turning in detail to the drawings, FIG. 1 illustrates a remote-operated control system 10 for a pool or spa. In a preferred embodiment, the system 10 comprises two units: a remote-control unit 12 and a master-control unit 14.

The remote-control unit 12 of FIG. 1 includes an associated transceiver 16, which is preferably mounted on a printed circuit board of the remote-control unit 12. In a preferred embodiment, the remote-control unit 12 also includes a processor which includes an encoder and a decoder associated with the transceiver 16. The remote control also includes address switches 22, a keypad 24, and LCD display 26, and a battery 28.

In the remote-control unit 12 of FIG. 1, which in a preferred embodiment is hand-held, the battery 28 serves as a power source. The keypad 24 is connected to send electrical signals to the processor 18, which receives addressing in the form of electrical signals from the address switches 22. The encoder is connected to encode the encoded signal from the keypad and send the encoded signal to the transceiver 16. The processor's decoder, which likewise receives addressing in the form of electrical signals from the address switches 22, is connected to decode electrical signals received from the transceiver 16 and to send the decoded signals to the LCD display 26.

The master-control unit 14 of FIG. 1 likewise includes an associated PPM transceiver 30. In a preferred embodiment, the transceiver 30 is identical to the transceiver 16 that is associated with the remote-control unit 12. Preferably, the transceiver 30 is mounted externally to a wall of the master-control unit 14. The preferred master-control unit 14 also contains a processor 36 which includes an encoder 32 and a decoder 34 associated the transceiver 30, and a processing unit. The master control unit also includes address switches 38, a temperature sensor 40, a safety hi-limit circuit 42, relay control logic 44 and an associated fireman's switch 46, a power supply 48, and eight relays 50, 52, 54, 56, 58, 60, 62, 64.

In the master-control unit of FIG. 1, the encoder and the decoder are addressed with electrical signals sent from the address switches 38. The decoder is connected to receive and decode electrical command signals from the transceiver 30 and to send the decoded signals to the processing unit. The processor 36 is connected to send the command signals to the relay control logic 44. The encoder is connected to encode status signals received from the processing unit and send the encoded signals to the transceiver 30. The status signals that the processor sends to the encoder carry temperature information that the processor 36 receives from the temperature sensor 40. In a preferred embodiment, the temperature sensor 40 comprises two thermistors, one used to sense water temperature and the other serving to sense when water temperature has exceeded a preset ceiling level, or hi-limit. Preferably, the hi-limit is 112 degrees Fahrenheit, but alternatively it can be set to 116 degrees Fahrenheit. The relay control logic 44 controls the safety hi-limit circuit 42, which senses when water temperature has reached a predetermined ceiling level and shuts off the water heater by sending an electrical signal to the on/off heater relay 50. The on/off jets relay 52, on/off pump relay 54, on/off light relay 56, on/off aux 1 relay 58, on/off aux 2 relay 60, on/off aux 3 relay 62, and on/off ozonator relay 64 are individually connected to receive electrical control signals from the relay control logic 44.

Figure 2A:
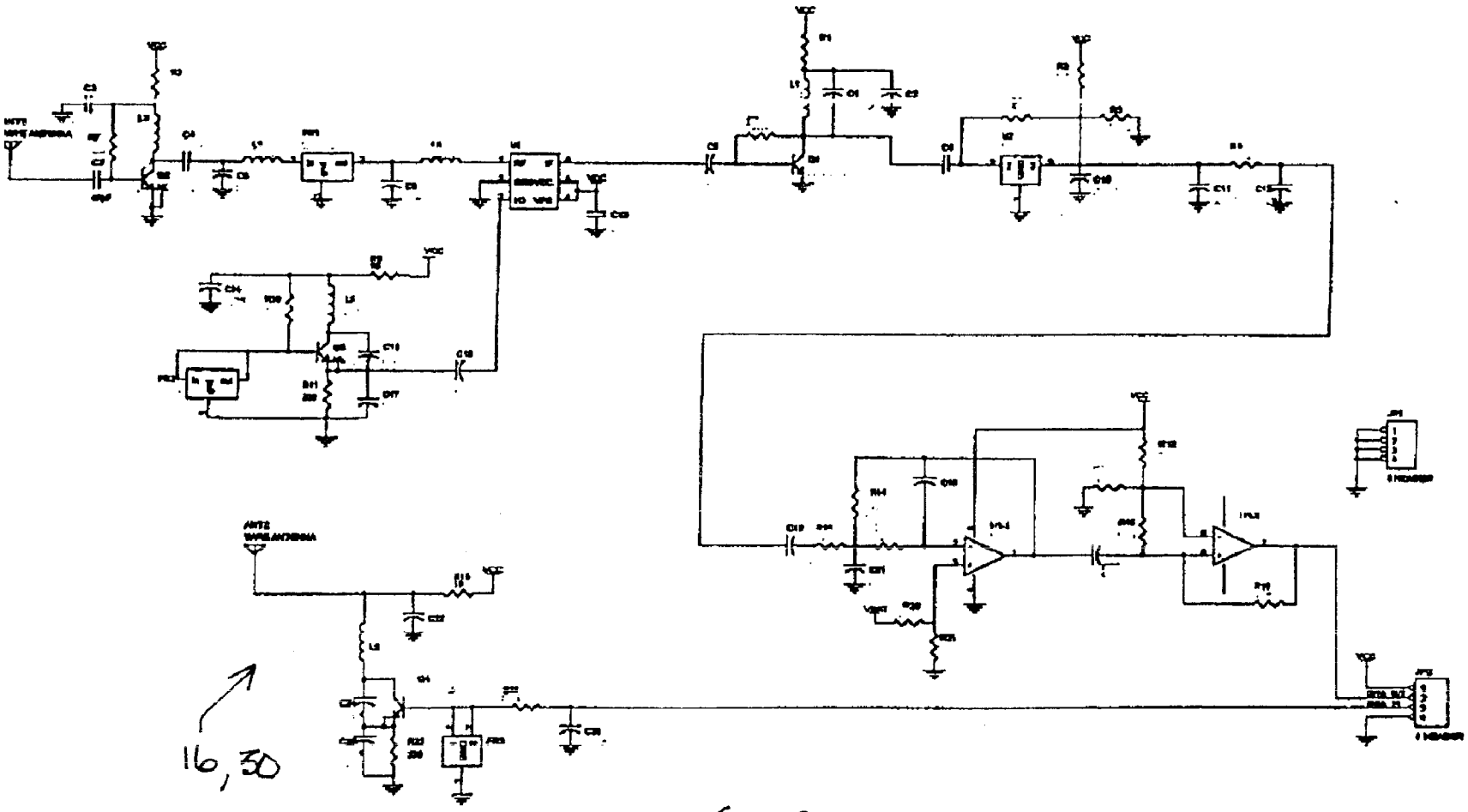
FIG. 2A is a schematic circuit diagram of the pulse position modulated transceiver.
Figure 2B:
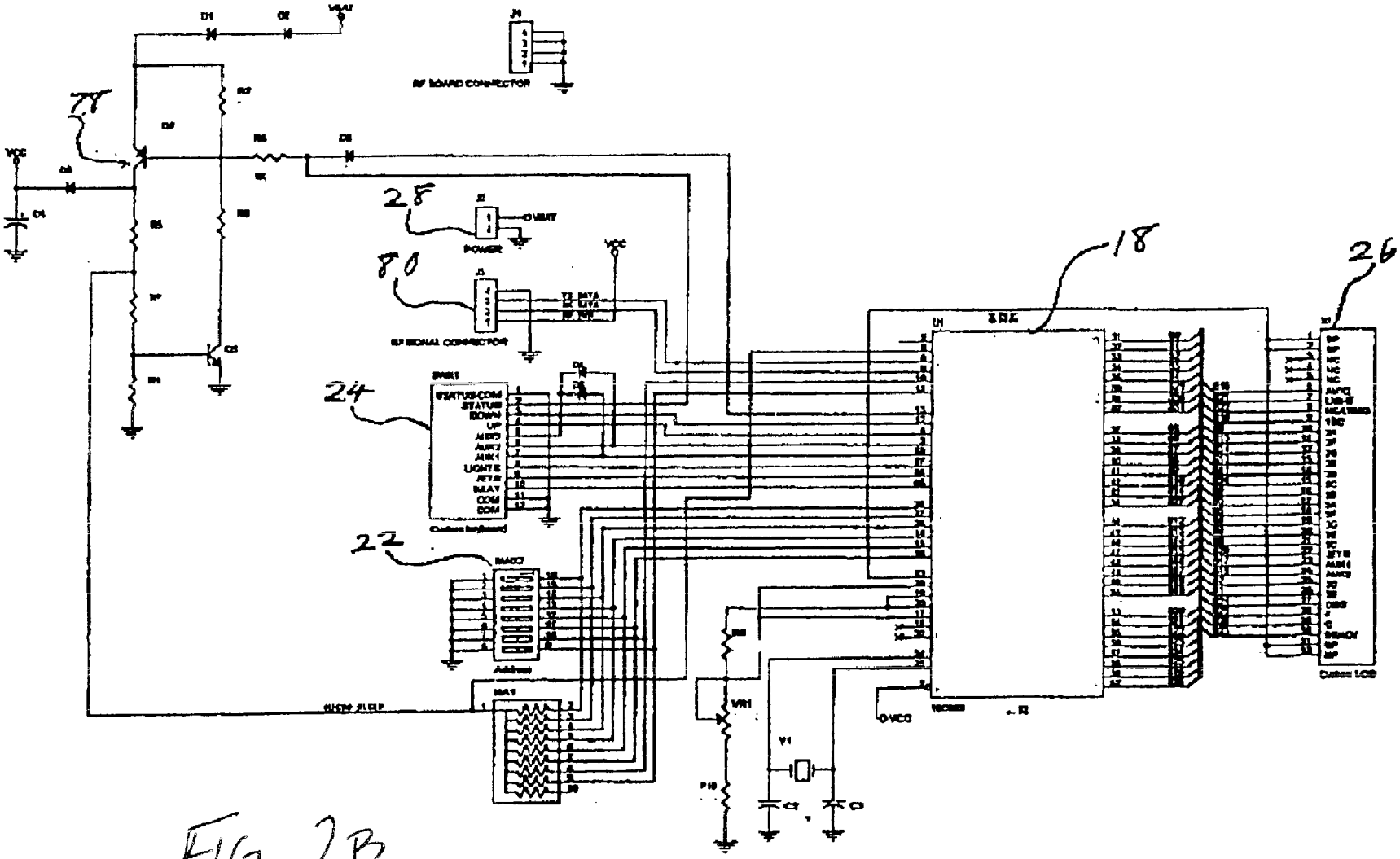
FIG. 2B is a schematic circuit diagram of encoder, keypad, and power circuitry in a remote-control unit in the system of FIG. 1.

With reference to FIG. 2B, a schematic diagram of circuitry in a preferred remote-control unit 12 is shown. FIG. 2B represents a preferred design for the remote-control unit 12 of FIG. 1 and would be readily understood by one of ordinary skill in the art. Moreover, one of skill in the art would also understand that many different designs for the remote-control unit 12 of FIG. 1, are possible.

FIG. 2B depicts an encoder and related electronics. Command signals manually input to the keypad 24 of FIG. 1 are sent to a buffer that stores the data. From the buffer 66 the data signals are sent to the encoder. The encoder is addressed by a switch 22. A battery 28 supplies power to the remote control unit 12. A pair of transistors within the processor serves as a sleep-mode circuit to cut off the Vcc power supply in the absence of user activity for a sustained time period. A third transistor ensures that no erroneous transmissions are generated during sleep mode. Also included is a timer, which sends a continuing message while the user depresses a keypad switch to switch back and forth between transmit and receive modes. A regulator 78 supplies Vcc (voltage) to the remote-control unit 12. A transceiver information element 80 transmits data from a TXD output of the encoder to the transceiver 16 of FIG. 1 and receives data from the transceiver 16 of FIG. 1. Data received from the transceiver 16 of FIG. 1 is sent to a decoder.

In FIG. 2B, a decoder and display electronics are also shown. The decoder receives the data at an RXD input. An address switch 22 provides addresses for the decoder (as well as for the encoder). The decoded data bits are sent to the processing unit.

Figure 3A:
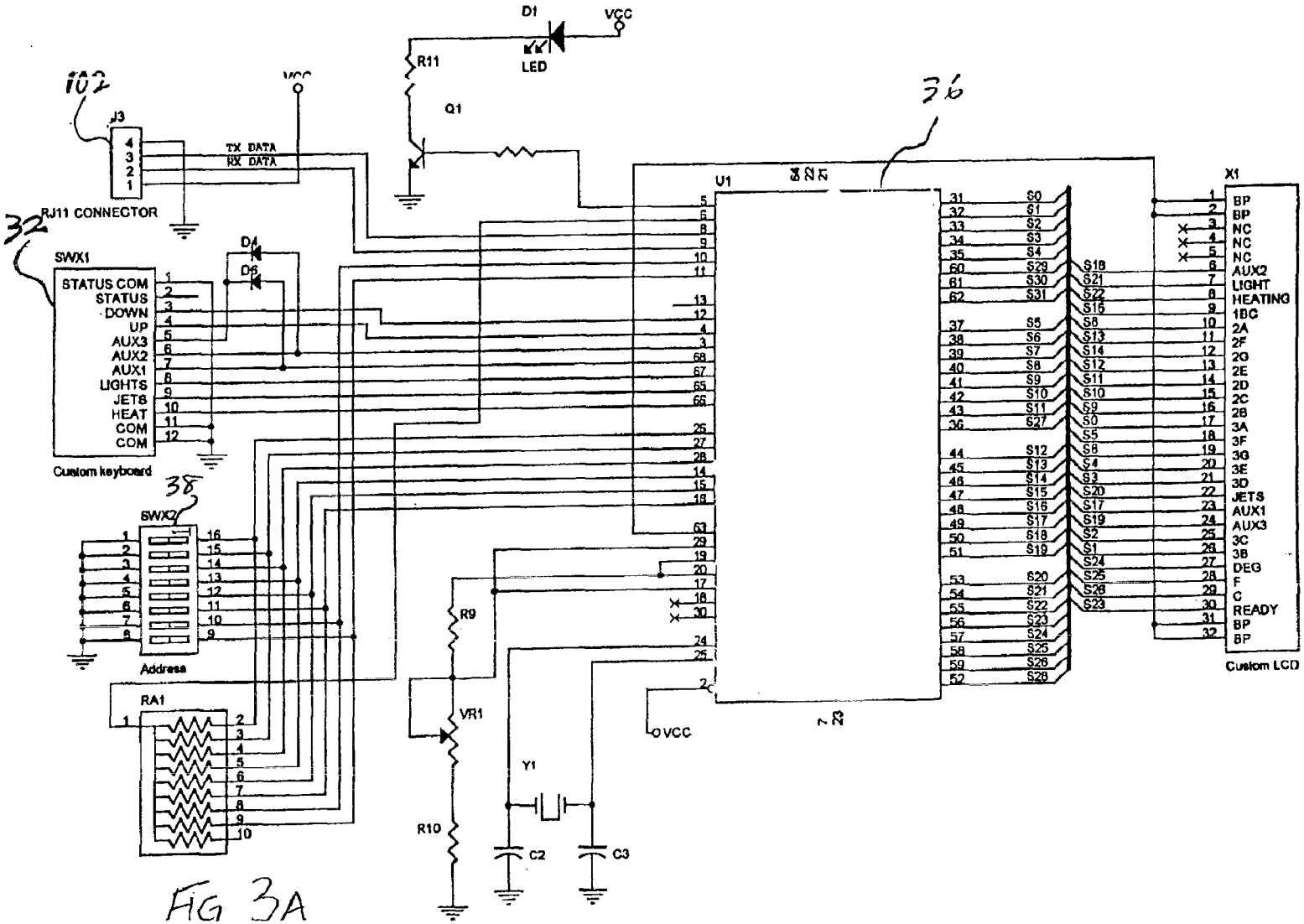
FIG. 3A is a schematic circuit diagram of decoder, encoder, address-switch, and processor circuitry in a master-control unit in the system of FIG. 1.
Figure 3B:
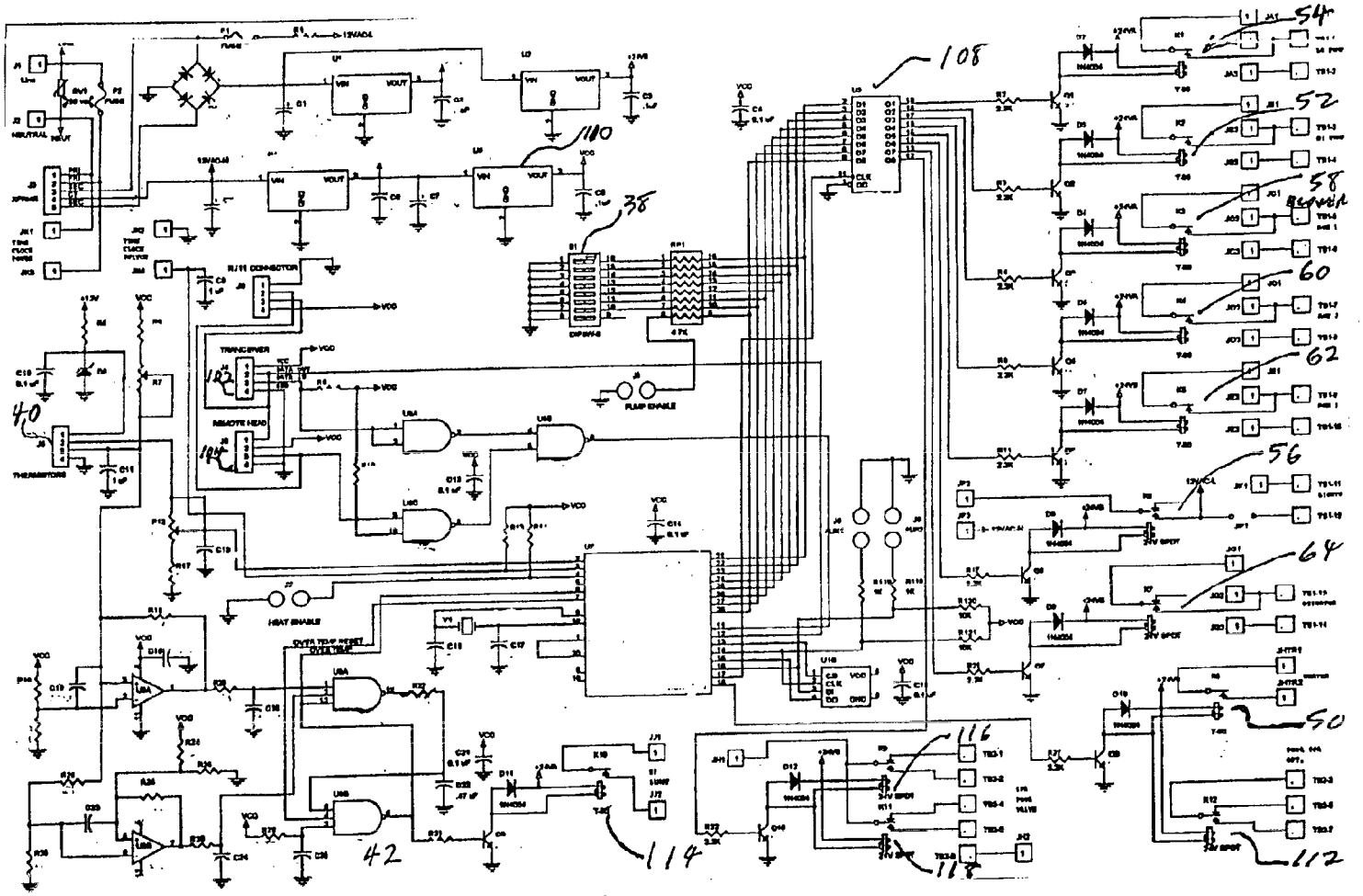
FIG. 3B is a schematic circuit diagram of control logic and relays in a master-control unit in the system of FIG. 1.

Referring now to FIGS. 3A–3B, a schematic diagram of circuitry in a preferred master-control unit 14 is depicted. FIGS. 3A–3B represent a preferred design for the master-control unit 14 of FIG. 1 and would be readily understood by one of ordinary skill in the art. Moreover, one of skill in the art would also understand that many different designs for the master-control unit 14 of FIG. 1 are possible.

FIG. 3A illustrates a processor 36, an address switch 38, and related electronics. In FIG. 3A a transceiver information element 102 receives command data from the transceiver 30 of FIG. 1 or sends status data from a TXD output of the processor's encoder to the transceiver 30 of FIG. 1. The transceiver information element 102 is also connected to send command data from the transceiver 30 to an RXD input of the processors decoder. In a preferred embodiment, a second transceiver information element 104 can be included with the transceiver information element 102. Outputs form the elements 102, 104 are OR'd such that a single RXD signal represents the OR result of the two outputs form the elements 102, 104. The decoder and encoder are connected to address switches 38, which in a preferred embodiment must address the decoder and encoder with the same eight-bit address used by the address switch 22 of FIG. 2B.

The decoder sends parallel bits of decoded command data through a parallel resistor block 106 to a data bus. The data bus is connected to carry the command data signals to the processor 36 and then transport the resultant command signals generated by the processor 36 to a storage buffer, which holds the command signals before sending them to the relay control logic 44 of FIG. 1. The processor 36 received at an A/D input a water-temperature status signal from two thermistors (i.e., the temperature sensor 40, of FIG. 1). The processor 36 sends status data signals (including the status signals received at the A/D input) to the encoder 32, which as stated above sends a resultant status signal from the TXD output to the transceiver information elements 102, 104. Additionally, the processor 36 outputs a heat-enabled command signal. The processor 36 is powered by a regulator 110 (FIG. 3B).

FIG. 3B shows control logic for nine relays 50, 52, 54, 58, 64, 112, 114, 116, 118. The control logic is a configuration of digital gates that forces one or more conditions to be satisfied in order for each relay 50, 52, 54, 58, 64, 112, 114, 116, 118 to turn on. Also, an over-temp (i.e., emergency shutdown) signal from the safety hi-limit circuit 42 prevents any of the relays 50, 52, 54, 58, 64, 112, 114 from being on.

Thus, for the low pump (i.e., filter pump) relay 54 to turn on, a heating command from the processor 36 must be present and there must be neither a jets command not an over-temp signal present. Alternatively, and also only if neither a jets command nor an over-temp signal is present, a pump-delay signal from the fireman's switch 46 will activate the filter pump relay 54. Finally, and again in the absence of both a jets command and an over-temp signal, the filter pump relay 54 can also be turned on manually from the remote time clock.

The high pump (i.e., jets) relay 52 turns on in the absence of an over-temp signal when a jets command is received from the processor 36. Likewise, the blower (i.e., aux 1) relay 58 turns on in the absence of an over-temp signal when an aux-1 command is received from the processor 36. The ozonator relay 64 turns on only if either the pump filter relay 54 or the jets relay 52 is on. The heater relay 50 turns on when the heating command is present and the over-temp signal is not present. In a preferred embodiment, an alternate heater relay 112, is provided for larger spas or pools. The heater relay 112 has the same control logic as the heater relay 50. A hi-limit relay 114 is also provided in a preferred embodiment. The hi-limit relay 114 is always on unless the over-temp signal is present. Preferably, a pool-valve relay 116 is provided, turning on in the presence of a heat-enable command signal. Advantageously, a spa-valve relay 118 is also provided to turn on if a heat-enable command is present. Neither the pool-valve relay 116 nor the spa-valve relay 118 require absence of the over-temp signal in order to be activated.

Control logic is also depicted for three other relays 56, 60, 62. As in FIG. 3B, the control logic is a configuration of digital gates that forces one or more conditions to be satisfied in order for each relay 56, 60, 62 to turn on. However, all of the relays 56, 60, 62 remain enabled regardless of whether an over-temp signal is present. Thus, the light relay 56 requires only the presence of a light command signal from the processor 36 in order for the light to be turned on. Similarly, the aux 2 relay is activated with the presence of an aux 2 command, and the aux 3 relay is activated with the presence of an aux 3 command.

A custom keyboard 32 to permit localized control may or may not be connected to the processor 36 depending upon desired configuration.

Figure 4A:
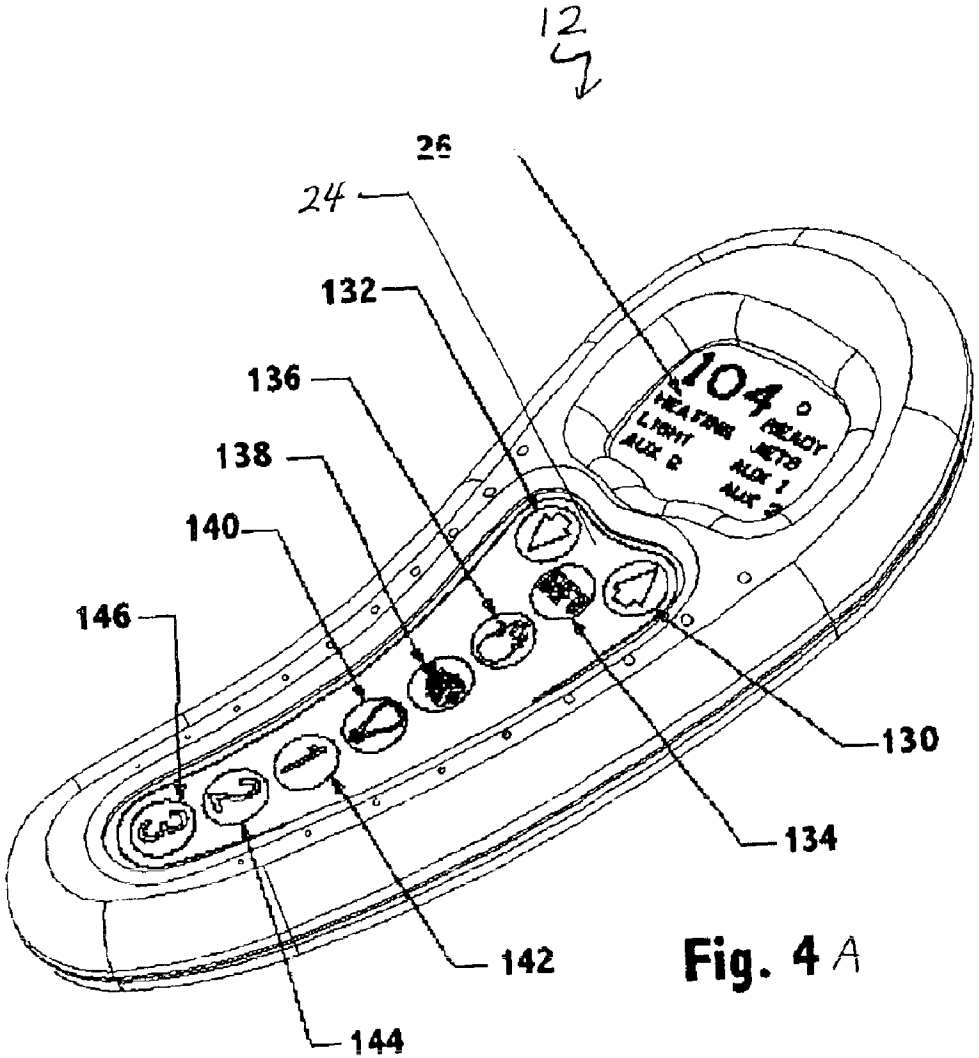
FIG. 4 is a perspective view of a remote-control unit in the system of FIG. 1.
Figure 4B:
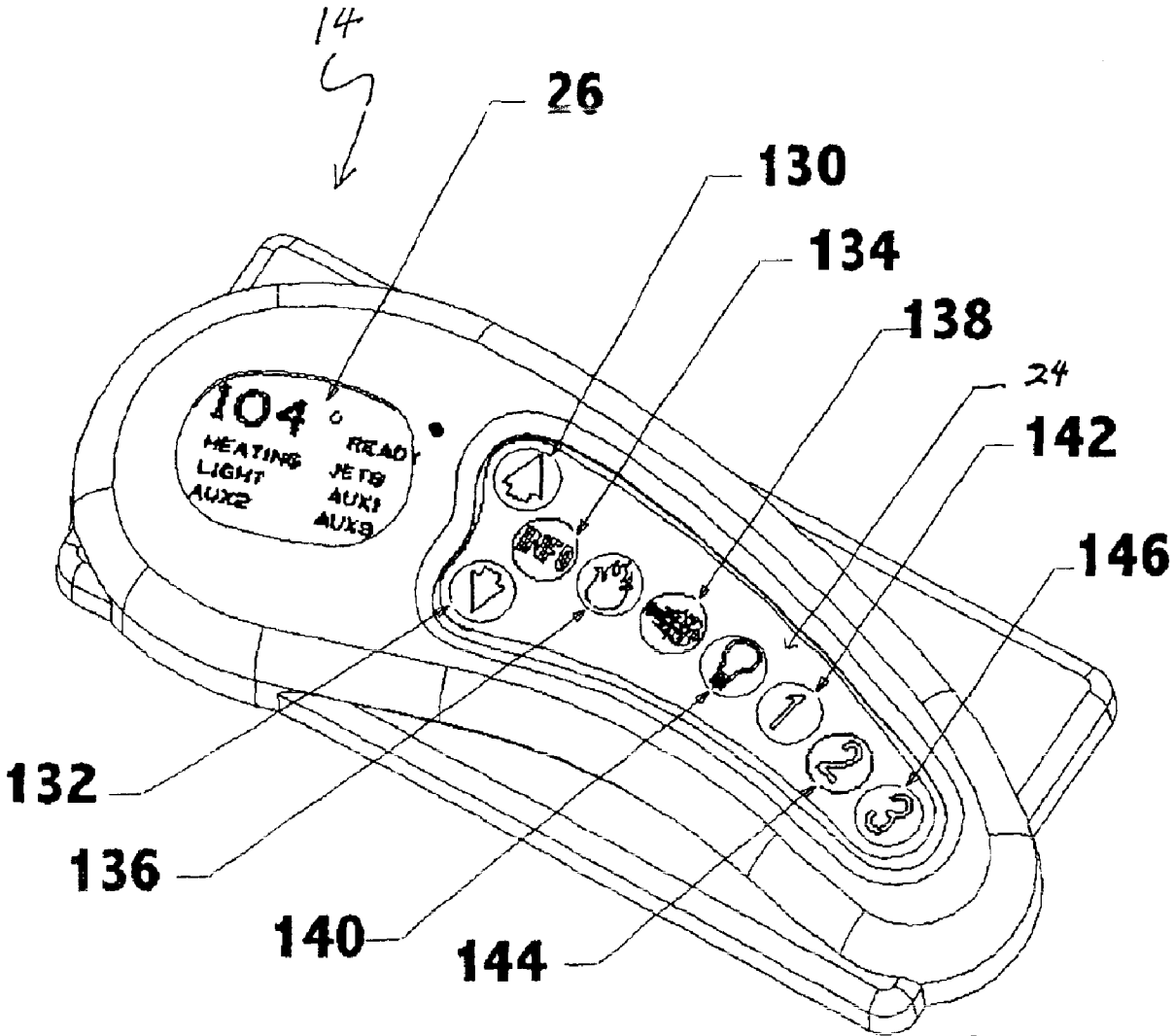

With reference to FIG. 4, a perspective view of the remote-control unit 12 according to a preferred embodiment is shown. The remote-control unit 12 includes an LCD display 26 and a keypad depicted generally as 24. The keypad 24 includes an up switch 130, a down switch 132, a status switch 134, a heat switch 136, a jets switch 138, a light switch 140, an aux 1 switch 142, an aux 2 switch 144, and an aux 3 switch 146. Preferably, the LCD display 26 displays two and one-half or more digits of temperature set point followed by actual water temperature and status icons. Also, the LCD display 26 can be connected to display temperature in either degrees Fahrenheit or degrees Centigrade. In a -preferred embodiment, the following status icons are displayed: READY; HEATING; JETS; LIGHT; AUX 1; AUX 2; AUX 3; and degrees F. or degrees C.

In operation of the remote-operated control system 10, the remote-control unit 12 is used to operate the master-control unit 14 and to receive and display temperature and status data. In a preferred embodiment, the master-control unit 14 operates portable-spa or spa/pool functions upon command from the remote-control unit 12. The master-control unit 14 interprets data from the remote-control unit 12 via the transceiver 30, and based on the data, either turns on or turns off the spa/pool functions. Preferably, an external time clock is attached to the master control unit 14 to operate the filter pump of the spa or pool automatically. The master-control unit 14 also sends temperature and status data back to the remote-control unit 12 upon request from the remote-control unit 12. The transceivers 16 and 30 operate at a preferred frequency of 915 megahertz. A keypad 24 on the master control unit 14 permits local control of the same functions as the remote control's 12 keypad.

With reference to FIG. 4, function of the switches 130, 132, 134, 136, 138, 140, 142, 144, 146 on the remote-control unit 12 is described according to a preferred embodiment. The up switch 130 raises water temperature in the spa to a set point. The up switch 130 also serves to reset the safety hi-limit circuit 42 of FIG. 1 in the event that the safety hi-limit circuit 42 has been tripped, i.e., if water temperature exceeded 112 degrees Fahrenheit. To accomplish the reset, the user depresses the up switch 130 and the down switch 132 together after the water temperature has cooled down to below 108 degrees Fahrenheit. When the up switch 130 is held in a depressed position, the transceiver 16 continues transmitting the up command and receives the updated temperature set point on the display 26, which updates at two-to-three seconds intervals. When the desired temperature set point is observed, the up switch 130 should be released. The set point increments in five-degree steps as the water temperature rises from thirty-five to eighty degrees Fahrenheit. Thereafter, until the temperature reaches 104 degrees Fahrenheit, the set point increments in one-degree steps.

The down switch 132 operates similarly to the up switch 130, except that the down switch 132 lowers the temperature set point instead of raising it. As discussed above, if the down switch 132 and the up switch 130 are depressed together, a preset safety hi-limit command is initiated to clear the safety hi-limit emergency shutdown provided the water temperature is below 108 degrees Fahrenheit.

The status switch 134 provides several functions. First, the status switch 134 activates the Vcc power supply if the remote-control unit 12 is in sleep mode. Second, the status switch 134 serves to request temperature and status information from the master-control unit 14. Third, the status switch 134 can be used to clear the reset to the safety hi-limit circuit 42.

The heat switch 136 is used to send a heat command to the master-control unit 14. The heat command toggles the heat mode between on and off. When the heat mode is on, one of two status icons is shown on the display 26. A HEATING icon is shown if the water temperature is below the temperature set point. Otherwise, i.e., if the water temperature is equal to or above the temperature set point, a READY icon is displayed. In similar fashion the jets switch 138 sends a jets command to the master-control unit 14 that toggles the jets function between on and off. When the jets function is on, the JETS icon is shown on the display 26. Likewise, the light switch 140 sends a light command to the master-control unit 14 that toggles the light function between on and off. When the light function is on, the LIGHT icon is shown on the display 26. The aux 1 switch 142, the aux 2 switch 144, and the aux 3 switch 146 are used in the same manner as the jets switch 138 and the light switch 140. The aux 1 function is generally used to control blower motor.

In a preferred embodiment, the remote-control unit 12 also includes a sleep circuit designed to turn off the Vcc power supply if there has been no action from the keypad 24 for fifteen seconds. As discussed above, the status switch 134 must be depressed to reactivate the Vcc power supply. The two address words from the address switches 22, 38 must match in order to have verified transmission from the decoder 20.

In operation of the master-control unit 14, the processor 36 controls all of the master-control functions in a preferred embodiment, except for the time clock and the safety hi-limit shutdown. The tasks of the processor 36 include monitoring water temperature; storing temperature set point; reacting to received commands such as heat commands, status commands, jets commands, light commands, aux 1 commands, aux 2 commands, or aux 3 commands; resetting the safety hi-limit; and conditioning temperature set point when power is applied to the processor 36.

The processor 36 monitors the water temperature via a thermistor connected to the A/D input of the processor 36.

The processor 36 converts the analog input into degrees Fahrenheit, accounting for the thermistor curve. Also, if the water temperature exceeds 112 degrees Fahrenheit (as monitored via a second thermistor), the processor 36 shuts down all functions and sends a character back to the remote-control unit 12. The character appears on the display 26 as a HI icon in lieu of the temperature display when the status switch 134 of the remote-control unit 12 is depressed.

The processor 36 stores a temperature set point that increments in five-degree steps from thirty-five to eighty degrees Fahrenheit, and in one-degree steps from eighty to 104 and from thirty-two to thirty-five degrees Fahrenheit. The temperature set point can be incremented up by sending an up command or down by sending a down command from the remote-control unit 12. Upon receipt of either an up or a down command, the processor 36 sends the temperature set point to the remote-control unit 12. In addition, when a status command is received the processor 36 sends the temperature set point- to the remote-control unit 12 with the actual temperature data following in approximately two seconds.

When a heat command is received from the remote-control unit 12, the processor 36 sends a heat-enable command to the relay control logic 44. Then the processor 36 compares the water temperature with the temperature set point. If the water temperature is lower than the temperature set point, the processor 36 sends a heating command signal to the relay control logic 44 and sends back to the remote-control unit 12 a status message including data to display the HEATING icon. If instead the water temperature is equal to or higher than the temperature set point, the processor 36 sends back to the remote-control unit 12 a status message including data-to display the READY icon. In a preferred embodiment, the HEATING and READY icons are never shown simultaneously on the display 26. When in the heat mode, the processor 36 periodically compares the water temperature with the temperature set point and turns the heating command signal to the relay control logic 44 on or off accordingly as required to maintain correct water temperature (with hysteresis of one degree Fahrenheit). If a heat command is received while the processor 36 is in the heat mode, the processor 36 exits the heat mode and, if necessary, turns off the heat-enable command signal and the heating command signal to the relay control logic 44. The processor 36 then sends back to the remote-control unit 12 a status message that clears the HEATING icon or READY icon from the display 26.

When a status command is received from the remotecontrol unit 12, the processor 36 sends a status message back to the remote-control unit 12. This status message always contains information to turn on or turn off the status icons as required and then display the temperature set point followed in roughly two seconds by the actual water temperature. The status command also clears the reset command signal to the safety hi-limit circuit 42 as discussed above.

When a jets command is received from the remote-control unit 12, the processor 36 turns on the jets command signal to the relay control logic 44 and returns a status message to the remote-control unit 12. Another jets command from the remote-control unit 12 causes the processor 36 to turn off the jets command signal to the relay control logic 44. In a preferred embodiment, if the processor 36 receives no jets command from the remote-control unit 12 after spending a specified time in the jets mode, the processor 36 automatically turns off the jets command signal to the relay control logic 44.

The aux 1 command is used in a preferred embodiment to operate the blower motor of the spa. The processor 36 handles a received aux 1 command in the same fashion as a jets command. The light command also is handled like the jets command, except that no similar time limit is provided to turn the light off after a specified time without a received light-on command. The aux 2 and aux 3 commands are handled like the light command.

As discussed above, a safety hi-limit command can be generated by simultaneously depressing the up switch 130 and the down switch 132 of the remote-control unit. If the water temperature is below 108 degrees Fahrenheit, the processor 36 sends a reset command signal to the safety hi-limit circuit 42. A status command from the remote-control unit 12 clears the reset command.

A preferred embodiment includes a safety hi-limit circuit 42 that is completely independent from the processor 36, except that a reset command signal from the processor 36 is necessary to clear the emergency shutdown. The safety hi-limit circuit 42 detects both water temperature and the condition of the discrete thermistors, such as an open thermistor or a cut thermistor cable. The emergency shutdown command is sent directly from the safety hi-limit circuit 42 to the on/off heater relay 50.

In a preferred embodiment, the relay Control logic 44 controls the built-in relays 50, 52, 54, 56, 58, 60, 62, 64. The on/off pump relay 54 is operated from three sources. First, provided the safety hi-limit shutdown signal and the jets command signal from the processor 36 are off, the on/off pump relay 54 turns on when the heating command signal is sent from the processor 36 to the relay control logic 44. Second, the on/off pump relay 54 can be turned on by the remote time clock if the jets command signal is not present. Third, the on/off pump relay 54 can be activated by the pump delay, or fireman's switch, circuit 46 in the absence of the jets command signal. In a preferred embodiment, the fireman's switch 46 turns on approximately two minutes after the processor 36 generates the heating command signal, and remains on until approximately fifteen minutes after the heating command signal is turned off. This allows the heater to go through a cool-down period before the water flowing through the heater is turned off. Whenever the jets command is turned on, the on/off pump relay 54 turns off. However, provided any of the above-discussed three conditions is met, the on/off pump relay 54 turns back on as soon as the jets command is turned off.

The on/off jets relay 52 turns on whenever the jets command is received from the processor 36 by the- relay control logic 44, provided the safety hi-limit shutdown signal is off. The on/off light relay 56 turns on when the light command is received from the processor 36 by the relay control logic 44. However, the safety hi-limit shutdown signal need not be off because the water temperature is unrelated to whether the light is on or off. In a preferred embodiment, alternate light-function applications are provided. In the portable-spa setting twelve volts AC is wired to the spa light. In contrast, the spa/pool setting provides 115 volts AC for the pool or spa lights.

The on/off aux 1 relay 58, normally used for the spa blower in a preferred embodiment, is turned on when the aux 1 command is present and the safety hi-limit shutdown signal is absent. The on/off aux 2 and on/off aux 3 relays 60, 62 are activated when the aux 2 or aux 3 commands are present. The on/off ozonator relay 64, which is used only in the portable-spa application of a preferred embodiment, is turned on if either the on/off pump relay 54 or the on/off jets relay 52 is on. In a preferred embodiment, a hi-limit relay 114 is provided for use only with the portable-spa application. The hi-limit relay 114 is always on unless the safety hi-limit shutdown signal is present.

Like most of the other relays, the on/off heater relay 50 turns on when the heating command is present unless the safety hi-limit shutdown is present. The on/off heater relay 50 is preferably used only for portable-spa applications.

Advantageously, an option can be provided via a jumper or a switch to inhibit the heater from coming on if either the on/off pump relay 54 or the on/off aux 1 (blower) relay 58 is on. Preferably, this option is only provided for low-power systems that also use 1.5 kilowatt or lower AC heaters. Most desirably, the on/off heater relay 50 is wired in series with an external pressure switch and does not operate unless the pump motor is running. In a preferred embodiment, an additional on/off heater relay 112 can be provided, operable under the same conditions but for use in pool/spa applications with gas-heater thermostats. it may also be advantageous in spa/pool applications to provide an on/off pool-valve relay 116 that turns on when the heat-enable command signal is present. An external twenty-four-volt AC transformer can be used to operate the pool valve. In similar fashion an on/off spa-valve relay 118 can be provided.

As stated above, a preferred frequency for the transceivers 16, 30 is 915 megahertz. This frequency is acceptable in both the United States and Canada, and allows the transceivers to communicate with each other through free air over a distance of greater than 1000 feet.

While preferred embodiments have been shown and described, it will be apparent to one of ordinary skill in the art that numerous alterations may be made without departing from the spirit or scope of the invention. Therefore, the invention is not to be limited except in accordance with the following claims.

What is claimed is:

1. A pool or spa remote-operated control system comprising:

a master-control unit and a remote-control unit capable of radio transmission therebetween for use with the pool or spa;

said remote-control unit including a first pulse position modulated transceiver associated therewith;

said master-control unit including a second pulse position modulated transceiver associated therewith; and said remote-control unit having a display that enables a user to ascertain the status of at least one operating parameter of the pool or spa, whereby said remote-control unit and said master-control both include means for both controlling necessary operating functions and obtaining status information regarding operating parameters.

2. The system of claim 1, wherein said remote-control unit and said master control unit communicate bidirectionally with pulse position modulated radio signals, using distributed data processing.

3. The system of claim 1, wherein said display enables the user to determine the temperature of water in the pool or spa.

4. The system of claim 1, wherein said remote-control unit comprises a keypad that enables a user to send at least one control signal to said master-control unit.

5. The system of claim 4, wherein the control signal tells said master-control unit to turn a spa heater on or off.

6. The system of claim 4, wherein the control signal tells said master-control unit to turn spa jets on or off.

7. The system of claim 4, wherein the control signal tells said master-control unit to turn a spa light on or off.

8. A remote-operated control-and-status-update system for a pool or spa comprising:

a remote-control unit including a display and a keypad;

a first transceiver connected to said remote control unit;

a master-control unit attached to a pool or spa; and with distributed solid state data processing; and a second transceiver connected to said master control unit;

wherein said first transceiver sends command signals to said second transceiver and said first transceiver, receives status signals from said second transceiver; and wherein the command signals and the status signals are pulse position modulated radio waves that travel through air between said first and second transceivers, wherein said remote-control unit and said master-control unit both include means for both controlling necessary operating functions and obtaining status information regarding operating parameters.

9. The system of claim 8, wherein said first transceiver sends to said second transceiver command signals that were manually input to said remote-control unit via the keypad, and wherein said first transceiver receives from said second transceiver status signals that are communicated to a user via the display using distributed solid state data processing.

10. A method of communicating control information from a distance to a control-and-monitor unit and obtaining status information from a distance from a control-and-monitor unit, the control-and-monitor unit associated with a pool or spa, the method comprising the steps of:

transmitting from a remote-control unit to the master-control unit at least one pulse position modulated radio-wave signal command concerning an operating function of the pool or spa;

sending from the remote control unit to the master-control unit at least one pulse position modulated radio-wave signal requesting that status information concerning operating parameters of the pool or spa be sent from the master-control unit to the remote-control unit; and reading status information displayed by the remote-control unit and received from the master-control unit in response to the request signal of said sending step.

11. The method of claim 10, wherein said transmitting steps and said sending step are performed when the remote-control unit is situated inside a building and the master-control unit is situated outside of the building.

12. The method of claim 10, wherein said transmitting step comprises transmitting a command signal to turn a spa heater on or off.

13. The method of claim 10, wherein said transmitting step comprises transmitting a command signal to turn spa jets on or off.

14. The method of claim 10, wherein said transmitting step comprises transmitting a command signal to turn a spa light on or off.

15. The method of claim 10, wherein said sending step comprises sending a signal requesting the water temperature of the pool or spa.

* * * * *

UNITED STATES PATENT AND TRADEMARK OFFICE

CERTIFICATE OF CORRECTION

PATENT NO. : 6,900,736 B2
DATED : May 31, 2005
INVENTOR(S) : Crumb

It is certified that error appears in the above-identified patent and that said Letters Patent is hereby corrected as shown below:

Column 10,
Line 9, delete “transceiver,”, insert -- transceiver --.

Signed and Sealed this

Eighteenth Day of October, 2005

JON W. DUDAS
*Director of the United States Patent and Trademark Office*